US005099950A

United States Patent [19]

Kishi

[11] Patent Number: 5,099,950

[45] Date of Patent: Mar. 31, 1992

[54] LIFTING APPARATUS

[75] Inventor: Mitsuhiro Kishi, Tochigi, Japan

[73] Assignee: Japanic Corporation, Tochigi, Japan

[21] Appl. No.: 643,565

[22] Filed: Jan. 18, 1991

[30] Foreign Application Priority Data

Jan. 22, 1990 [JP] Japan ..... 2-12313
Apr. 17, 1990 [JP] Japan ..... 2-101431

[51] Int. Cl.[5] ..... B66F 11/04; E04G 1/22

[52] U.S. Cl. ..... 182/18; 182/63; 182/141; 187/18

[58] Field of Search ..... 182/63, 141, 19, 127; 187/18

[56] References Cited

U.S. PATENT DOCUMENTS 3,619,007 11/1971 Phillips ..... 187/18
3,820,631 6/1974 King ..... 182/63
4,466,509 8/1984 Kishi .
4,518,061 5/1985 Wehmeyer ..... 187/18

FOREIGN PATENT DOCUMENTS 58-2197 1/1983 Japan .
58-2198 1/1983 Japan .
58-36900 3/1983 Japan .
58-95100 6/1983 Japan .
59-118698 7/1984 Japan .
60-118599 6/1985 Japan .
60-128197 7/1985 Japan .

*Primary Examiner*—Rinaldo P. Machado
*Attorney, Agent, or Firm*—Flynn, Thiel, Boutell & Tanis

[57] ABSTRACT

A lifting apparatus having a least one set of paired stretchable boom assemblies which extend and contract, preferably in five stages. The boom assemblies are disposed between a chassis and a platform for raising and lowering the platform in interlocking relation with an operating mechanism, a guiding mechanism and a synchronizing mechanism. The lifting apparatus further includes a kick mechanism for auxiliarily supporting the load on the platform at a position where the platform is lowered about halfway. The kick mechanism has one end fixed to the chassis and the other end provided with a kick body capable of supporting the centers of the boom assemblies and provided with a detecting means for detecting contact between the boom assemblies and the kick mechanism.

18 Claims, 15 Drawing Sheets

LIFTING APPARATUS

BACKGROUND OF THE INVENTION

1. Field of the Invention

The present invention relates to a lifting apparatus for use in assembling a building at an elevated spot, painting and the like at the elevated spot, lifting operators or materials upward for operation at the elevated spot or loading and unloading disused building materials at the building work, particularly to the lifting apparatus capable of lifting a platform to the elevated spot irrespective of the short length of a lifting mechanism at folding state and of preventing wires, chain for connecting each boom from being broken.

2. Prior Art

There has been employed a lifting apparatus for assembling, painting, repairing a building, and the like at an elevated spot, which apparatus is capable of lifting or lowering for loading operators or building materials and the like thereon or unloading the disused materials therefrom.

There has been employed a pantograph type telescopic mechanism, i.e. scissors type comprising a first pair of arms pivotally connected with each other at a central portion thereof and plural pairs of arms connected with the first pair of arms. In this apparatus, it was necessary to lengthen the length of the pairs for increasing the maximum height of the apparatus. Hence, if an apparatus capable of lifting upward as high as possible is-designed, it was necessary to employ a plurality of paired pantographs, which entails increasing the height of the apparatus when folded whereby it is more troublesome for an operator to get thereon or thereoff or to load materials thereon or unload materials therefrom.

There have been various proposed arrangements to solve the problems set forth above, for example the one as disclosed in U.S. Pat. No. 3 820 631. In a mechanism as proposed by this patent, a lower boom and an upper boom are respectively capable of moving linearly into a middle boom, the lower boom is pivotally mounted on a chassis at the end thereof, the upper boom is pivotally mounted on a platform at the end thereof, and these booms are assembled to form an X-shape. In this mechanism, inasmuch as the length of the boom per se becomes long, the height of the platform when folded can be decreased and the platform can be raised to the elevated spot.

However, in this known mechanism, inasmuch as the mechanism for extending the lower boom and upper boom from the middle boom comprises a screw and a thread for engaging with this screw, the telescopic moving speed of the lower and upper booms relative to the middle boom is slow, and hence the platform cannot be moved quickly. Furthermore, since the sliding motion of the lower boom and the upper boom is made by a bevel gear provided at the central portion of the middle boom, the entire length of the combination of the lower boom and the upper boom extending from the middle boom reaches a length only half as long as the middle boom, and hence the mechanism has such a structure that the platform cannot be raised as high as possible.

There has also been proposed a mechanism wherein another boom is inserted into a boom to extend the length thereof so that the entire length thereof is lengthened. For example, in FIG. 4 of Japanese Patent Laid- Open Publication No. 53-19556, lower and upper booms respectively having small diameters are inserted into a middle boom having a large diameter so that the lower and upper booms inserted into the middle boom are pulled out to lengthen the entire length of the booms, whereby the platform is raised high.

However, in this latter mechanism, there is no mechanism for synchronizing the amount of extension and contraction of the lower boom pulled out from the middle boom with that of the upper boom as also pulled out from the middle boom. The lower and the upper booms move individually relative to the middle boom. The amount of extension and contraction is restricted by a link mechanism comprising bars, and hence the complete synchronization of the lower and upper booms relative to the middle boom cannot be achieved. Accordingly, the lower and upper booms cannot be connected to the platform by a pin and the like and a non-synchronized error of the amount of the extension and contraction between the lower and upper booms relative to the middle boom can be absorbed by rollers contacting the chassis and the platform. Hence, the platform is liable to swing because of accumulation of jolt caused by many supporting fulcrums and reception of the rolling motion by the roller. As a result, the mechanism is liable to swing due to wind and the like and is unstable, thereby causing the operator to feel anxious.

To solve the drawbacks set forth above, there has been proposed a mechanism as disclosed in Japanese Patent Application No. 56-41289. In this application, lower and upper booms are inserted into a middle boom while both the lower and upper booms are connected by coupling means at one end thereof and the movable direction of the coupling means can be turned by a turning means pivotally mounted on the middle boom.

In this latter mechanism, inasmuch as the upper boom is pulled out from the middle boom at the same time when the lower boom is extracted from the middle boom and the movable amount of the lower and upper booms are restricted by the coupling means, the movable amount of the lower boom equals that of the upper boom, and hence a pair of middle booms supported by the lower and upper booms at the center thereof turns in an X-shape to thereby raise the platform vertically upward. In this mechanism, since the lower and upper booms are accommodated in the middle boom, it is possible to stretch the entire length of the booms about three times as long as the length of the middle boom when the lower and upper booms are respectively pulled out, hence the platform can be raised high.

The above lifting apparatus is characterized in comprising a pair of X-shaped middle booms having upper and lower openings, upper and lower booms being pulled out from the middle boom through the upper and lower openings wherein the lower boom is connected to the chassis and the upper boom is connected with the platform. The mechanism has an X-shape if viewed from the side thereof. In this mechanism, it is possible to decrease the height of the mechanism when folded such as a scissors-type mechanism and secure the platform against swinging since the respective distal ends of the lower and upper booms are connected by the pins with the chassis and the platform, which enhances the safety. Furthermore, inasmuch as the lengths of the lower and upper booms can be substantially the same as the length of the middle boom, there are many advantages such as the platform can be raised high and the height for raising the platform can be increased compared with the entire lengths of the booms when folded.

However, there occurred the following first problem. That is, the conventional X-type lifting apparatus has a structure to extend and contract in three stages since the lower and upper booms are inserted into the middle boom. To increase the height of the platform, it is necessary to design the length of the middle boom to be set to be longer. Thus, the platform can be raised high by lengthening the middle boom. However, the entire length of the chassis accommodating the middle boom is lengthened, which entails drastic change in the design of the lifting apparatus. Hence, the height of the lifting apparatus to be raised is determined by the length of the middle boom and the entire length of the chassis which are great obstacles.

Accordingly, there is desired a development of the lifting apparatus capable of lifting the platform as high as possible while permitting the middle boom to have the same length as the conventional mechanism.

Next, in the aforesaid apparatus, there occurred the following second problem. That is, it was necessary to connect the middle boom to the upper and lower booms by wires or chains or the like for synchronizing the upper and lower booms relative to the middle booms. The length of the lower boom pulled out from the middle boom is synchronous with the movable length of the upper boom by connecting the upper end of the lower boom and the lower end of the lower boom with the wires, chains and the like, whereby the lifting mechanism is always maintained to form the X-shape. Although it is very simple in this arrangement to synchronize with use of wires, chains and the like, it was necessary to set the safety load toward the tensile stress in view of preventing an accident.

In setting the safety load, the safety load is insignificant when the ratio of height of the lifting mechanism when folded relative to that when raised at the maximum is small. However, if the same ratio is large, the design of the safety load becomes a very significant matter.

That is, when the platform is raised to an elevated spot, the angle of inclination of the booms relative to the horizontal is large and a component of the force of the load applied to the platform is not large. Hence, the tensile strength applied to the wires for connecting the lower boom to the upper boom is not excessive. However, when the platform is lowered, the angle of inclination of the booms relative to the horizontal becomes small and the component of the force of the load applied to the platform becomes large. This component of the force of the load is applied directly to the wires or chains serving for synchronization, hence the tensile strength becomes very strong. Accordingly, if the safety factor of the load applied to the wires, chains or the like is set to be small, there is a likelihood of generating such an accident load that the wires, chains or the like are broken by the component of the force. When the wires, chains or the like for connecting the lower boom with the upper boom are broken, the platform lowers suddenly which can cause injury or damage.

Accordingly, wires, chains or the like having low safety factor do not generate any problem when they are used for synchronization at the state where they are raised high but they become one of the reasons of generating accidents when the platform is lowered which increases the component of the force of the load, thereby possibly breaking the wires, chains or the like.

To prevent generation of such accidents, it is preferable to increase the safety factor and set the safety load of the wires, chains or the like to a large value. If the wires, chains or the like becomes thick to increase the safety factor, the wires becomes too thick, in the worst case, to function as the lifting apparatus due to deterioration in flexibility thereof.

SUMMARY OF THE INVENTION

It is therefore an object according to a first aspect of the present invention to provide a lifting apparatus capable of obviating the first problem set forth above. A gist of the present invention is to extend and contract the telescopic boom in five stages while keeping the synchronization therebetween so that the platform can be raised to an elevated spot higher than that made possible by the conventional three stage booms.

The platform when contracted and folded is low in its height and can be lowered to a height which is the same as that of a conventional platform, which thus facilitates loading and unloading of an operator as well as materials.

It is also an object according to a second aspect of the present invention to provide the lifting apparatus with a kick or support mechanism employed for initial lifting of the lifting mechanism, which kick mechanism can support auxiliarily the load of the platform at the position where the platform is lowered halfway. When the platform lowers and the angle of inclination of the boom is small and the component of the force of the load is increased, the load can be decomposed by the kick mechanism. Accordingly, even if the platform lowers at a position adjacent to the lowest position where the component of the force is increased to the greater extent close to infinity, the drawing force to be applied to the wires does not increase, whereby the safety factor of the wires, chains or the like can be set relatively low.

To achieve the object of the lifting apparatus according to the first aspect of the present invention, the lifting apparatus comprises a movable chassis, a platform disposed over the chassis and capable of raising and lowering, a lifting mechanism disposed between the chassis and the platform for raising the platform, a pair of X-shaped middle booms the centers of which are pivoted and capable of turning, lower middle booms slidably telescopically inserted into the middle booms along the longitudinal direction thereof from the lower end openings of the middle booms, lower booms slidably telescopically inserted into the lower middle booms from the lower end openings of the lower middle booms and connected to the chassis at the lower ends thereof, upper middle booms telescopically inserted into the middle booms along the longitudinal direction thereof from the upper end opening of the middle booms, and upper booms telescopically inserted into the upper middle booms from the upper end openings of the upper middle booms and connected with the lower surface of the platform at the upper ends thereof.

To achieve the object of the lifting apparatus according to the second aspect of the present invention, the lifting apparatus comprises a movable chassis, a platform disposed over the chassis and capable of raising and lowering, a pair of X-shaped middle booms the centers of which are pivoted and capable of turning, lower booms movable along the longitudinal direction of the middle booms and connected to the chassis at the ends thereof, upper booms movable along the longitudinal direction of the middle booms and connected to the platform at the upper ends thereof, a kick or support mechanism fixed on the chassis for lifting the centers of the middle booms and a detecting means for detecting the contact between the middle booms and the kick mechanism, the kick mechanism lowers while supporting the load of the middle booms upon reception of a detecting signal issued when the detecting means detects that the middle booms contact the upper end of the kick mechanism.

The above and other objects, features and advantages of the present invention will become more apparent from the following description taken in conjunction with the accompanying drawings.

DESCRIPTION OF THE PREFERRED EMBODIMENT

Figure 1:
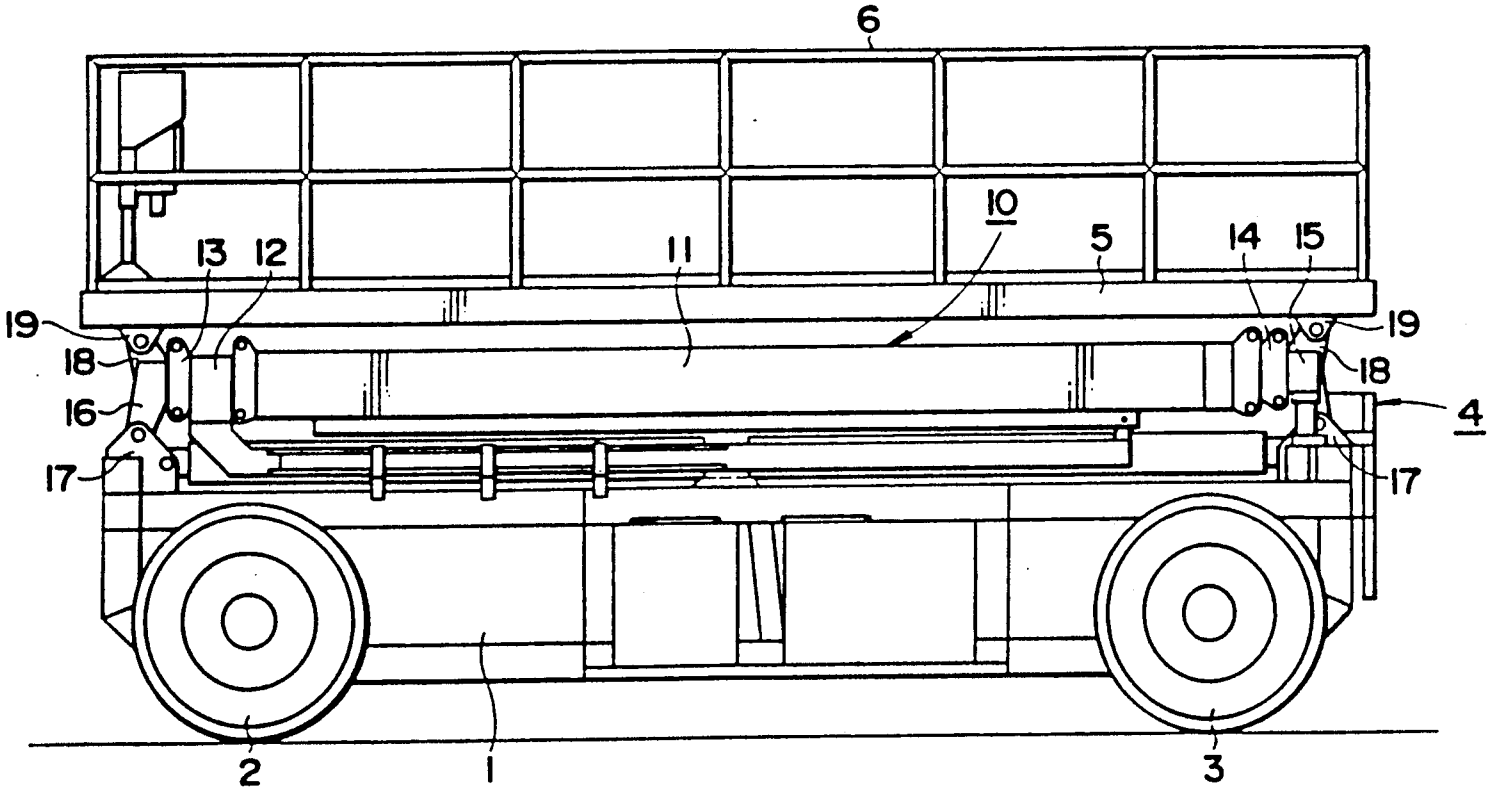
FIG. 1 is a side view of a lifting apparatus according to a first embodiment of the present invention in which a platform is at its lowest position.

First Embodiment (FIG. 1 to FIG. 13)

A lifting apparatus according to a first embodiment of the present invention will be described with reference to FIGS. 1 to 13.

The lifting apparatus comprises a movable chassis 1 having front wheels 2 and rear wheels 3 supported thereon, a lifting mechanism 4 mounted on an upper surface of the chassis 1, and a platform 5 disposed over the lifting mechanism 4 and having a handrail 6 fixed thereon. Fixed to the upper surface of the chassis 1 is a kick mechanism 7 for effecting an initial lifting of the lifting mechanism 6.

The lifting mechanism 4 comprises a pair of stretch boom assemblies each comprising two stretch booms 10. The stretch boom 10 comprises a middle boom 11, lower middle boom 12, lower boom 13, upper middle boom 14 and upper boom 15.

One pair of middle booms 11 among the stretch boom assembly are pivoted together in an X-shape at the inner central position thereof so that the middle booms 11 can pivot relative to one another. The lower middle booms 12 are inserted into the middle booms 11 from the lower end openings of the middle booms 11 so that the lower middle booms 12 can telescopically move in the longitudinal direction of the middle booms 11, and the lower booms 13 are inserted into the lower middle booms 12 from the lower end openings thereof so that the lower booms 13 can telescopically move along the longitudinal direction thereof. There are fixed coupling members 16 at the lower ends of the lower booms 13 which are pivotally coupled to members 17 fixed to the chassis 1 at the front and rear portions thereof.

The upper middle booms 14 are inserted into the middle booms 11 from upper end openings thereof so as to slide in the middle booms 11 in the longitudinal direction thereof. The upper booms 15 are inserted into the upper middle booms 14 from upper end openings thereof so as to telescopically move into the upper middle booms 14 in the longitudinal direction thereof. The upper booms 15 have coupling members 18 at the upper ends thereof which are pivotally coupled to members 19 which are fixed to the lower surface of the platform 5 at the front and rear portions thereof. The front-to-rear interval between the fixed members 17 is the same as the front-to-rear interval between the fixed members 19, whereby the platform 5 can rise upward while the chassis 1 and the platform 5 are maintained parallel with one another when the telescopic booms 10 turn to form the X-shape.

There are provided operating mechanisms 20 between the fixed members 17 and the lower middle booms 12. The operating mechanisms comprise hydraulic cylinders or guide mechanisms, details of which will be described later.

FIGS. 4 to 8 show the internal structure of the lifting mechanism 4, i.e. the internal structure or the combinations of the elements of the telescopic body or booms 10 which will be described in detail later.

The middle booms 11, the lower middle booms 12, the lower booms 13, the upper middle booms 14 and the upper booms 15 respectively form the telescopic bodies 10 and are made from thin metal plate by folding thereof for forming long hollow tubes which are rectangular in cross section. The middle booms 11 are rectangular in cross section and have a partition plate 25 for dividing the interior into two interior spaces which extend along the longitudinal direction thereof. The lower middle boom 12 is slidably inserted in one of the inner spaces. The lower middle boom 12 is structured as a hollow tube which is substantially rectangular in cross section. The lower boom 13 is slidably inserted into the lower middle boom 12. The lower boom 13 is also structured as a hollow tube of substantially rectangular cross section. The upper middle boom 14 is slidably inserted into the other inner space of the middle boom 11. The upper middle boom 14 is a hollow tube of substantially rectangular cross section. The upper boom 15 is slidably inserted into the upper middle boom 14 and a hollow tube of substantially rectangular cross section.

Figure 6:
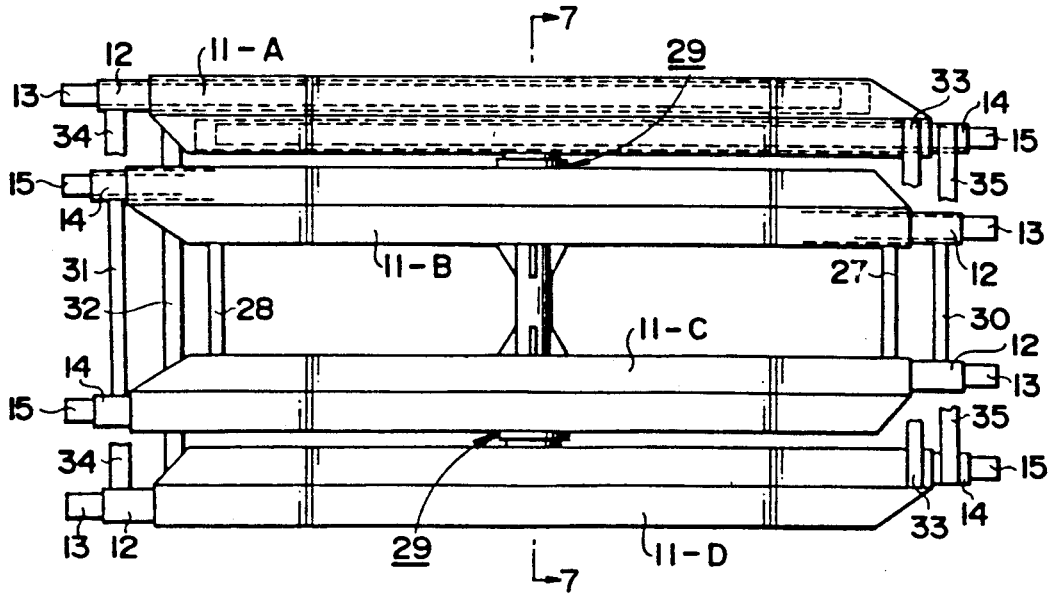
FIG. 6 is a plan view to assist in explaining the arrangement of the middle booms in the lifting mechanism.

The telescopic booms comprising the combination of the booms are disposed to be parallel with each other as shown in FIG. 6. In the same figure, four telescopic booms 10 are arranged in which the inner middle booms 11-B and 11-C are spaced from each other at a relatively large interval and a kick receiver 26 is intervened between the inner middle booms 11-B and 11-C at the central portions thereof. The kick receiver 26 contacts the upper end of the kick mechanism 7. Reinforcing rods 27 and 28 are fixedly provided between the inner middle booms 11-B and 11-C at the upper and lower portions thereof. There is formed a lattice shaped structure by the middle booms 11-B, 11-C, the kick receiver 26, and the reinforcing rods 27 and 28.

There is provided a bearing mechanism 29 between the middle booms 11-A and 11-B at the central portion thereof whereby the middle booms 11-A and 11-B can be freely turned relative to one another. Similarly, the middle booms 11-C and 11-D are also coupled with each other to be freely turned.

There is provided a reinforcing rod 30 fixed between the pair of middle booms 12 adjacent the lower ends thereof, and a reinforcing rod 31 fixed between the pair of upper middle booms 14 adjacent the upper ends thereof. The lower middle booms 12 and the upper middle booms 14 are slidable in synchronization with each other. A reinforcing rod 32 is coupled between the middle booms 11-A and 11-D at the upper end portions thereof and extends under the middle booms 11-B and 11-C. A reinforcing rod 33 is fixed between the middle booms 11-A and 11-D at the upper end portions thereof and extends over the middle booms 11-B and 11-C. Hence, the middle booms 11-A and 11-D are assembled in the shape of a lattice intervening the reinforcing rods 32 and 33 at the both end portions thereof and the assembled body is formed as a rigid structure by the combination of the middle booms 11-A and 11-D and the reinforcing rods 32 and 33. A reinforcing rod 34 is fixed between the lower middle booms 12 telescopically extending from the middle booms 11-A and 11-D and extending under the middle booms 11-B and 11-C for reinforcing both the lower middle booms 12. A reinforcing rod 35 is fixed between the upper middle booms 14 telescopically extending from the middle booms 11-A and 11-D and extending under the middle booms 11-B and 11-C, and the upper middle booms 14 are reinforced by the reinforcing rod 35.

Figure 7:
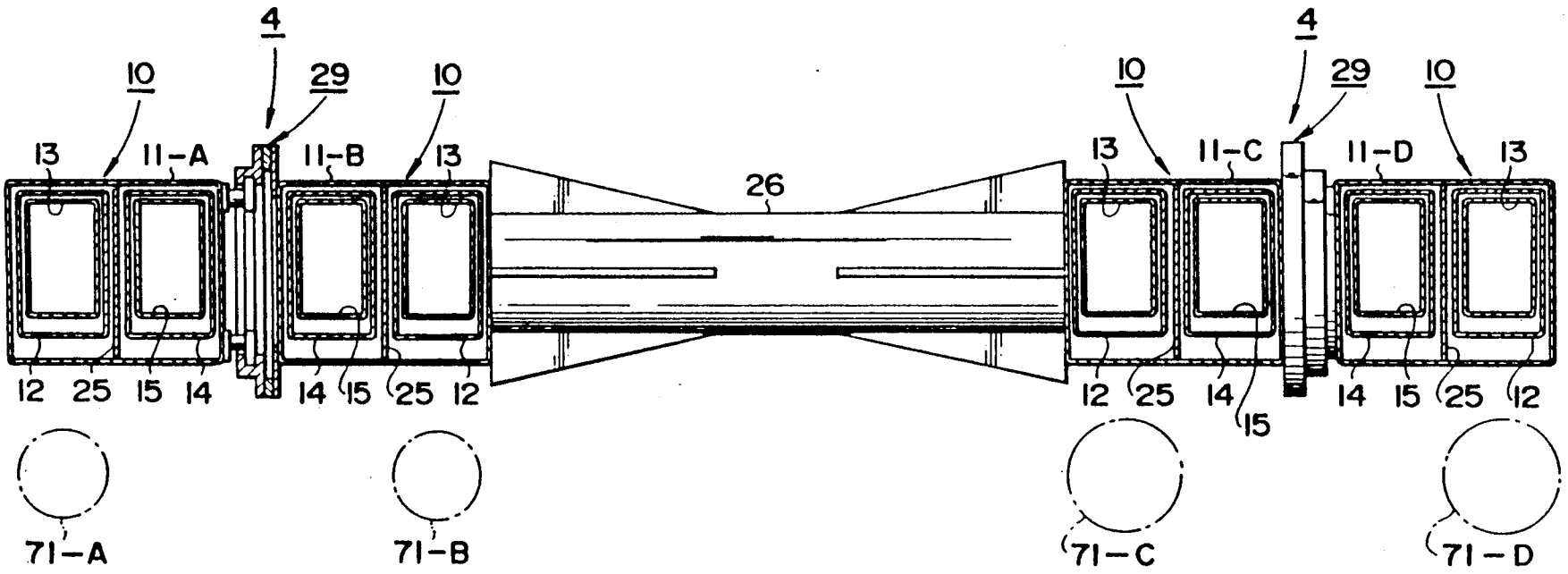
FIG. 7 is a cross sectional view taken along the line 7—7 in FIG. 6.

FIG. 7 is a cross sectional view taken along the line X—X in FIG. 6 and showing the relation between each of the middle booms 11-A, 11-B, 11-C, 11-D and the bearing mechanism 29.

Figure 8:
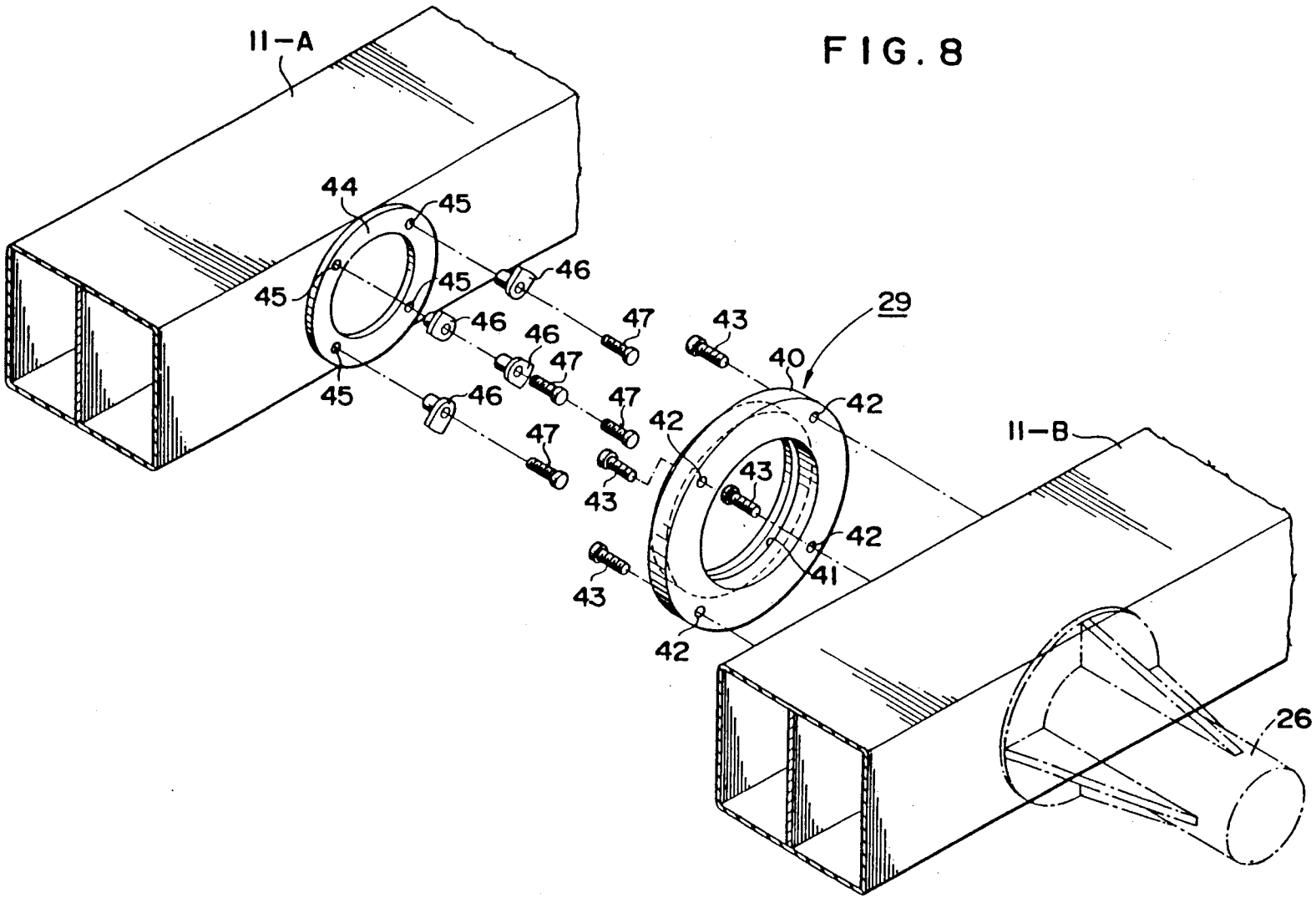
FIG. 8 is an exploded perspective view showing a structure of the bearing mechanism.

FIG. 8 is an exploded perspective view showing an arrangement of the bearing mechanism 29.

The bearing mechanism 29 permits the two middle booms 11-A and 11-B to turn or pivot relative to one another and includes a ring shaped bearing washer 40 which is brought into contact with an outer side surface of the middle booms 11-A and 11-B. The bearing washer 40 has a circular guide groove 41 defined in an inner peripheral wall thereof and a plurality of screw holes 42 defined on the peripheral surface thereof. The bearing washer 40 is disposed coaxially with the kick receiver 26 at the central axis thereof and brought into contact with the side surface of the middle boom 11-B and screwed thereto by inserting the screws 43 into the screw holes 42.

There is fixed a ring-shaped washer plate 44 at the inner side surface of the middle boom 11-A at the central portion thereof, which seat plate 44 has a plurality of screw holes 45 defined at the peripheral surface thereof.

A plurality of sliding retainer elements 46 are engaged in the guide groove 41 and have cylindrical hubs which are brought into alignment with the screw holes 45. The retainers 46 are fixed to the washer plate 44 by screws 47. Inasmuch as the retainers 46 are engaged in the peripheral guide groove 41 and are thereafter fixed to the washer plate 40 by the screws 47, the washer plate 44 and the bearing washer plate 40 are assembled so as to be rotatable relative to one another.

Figure 3:
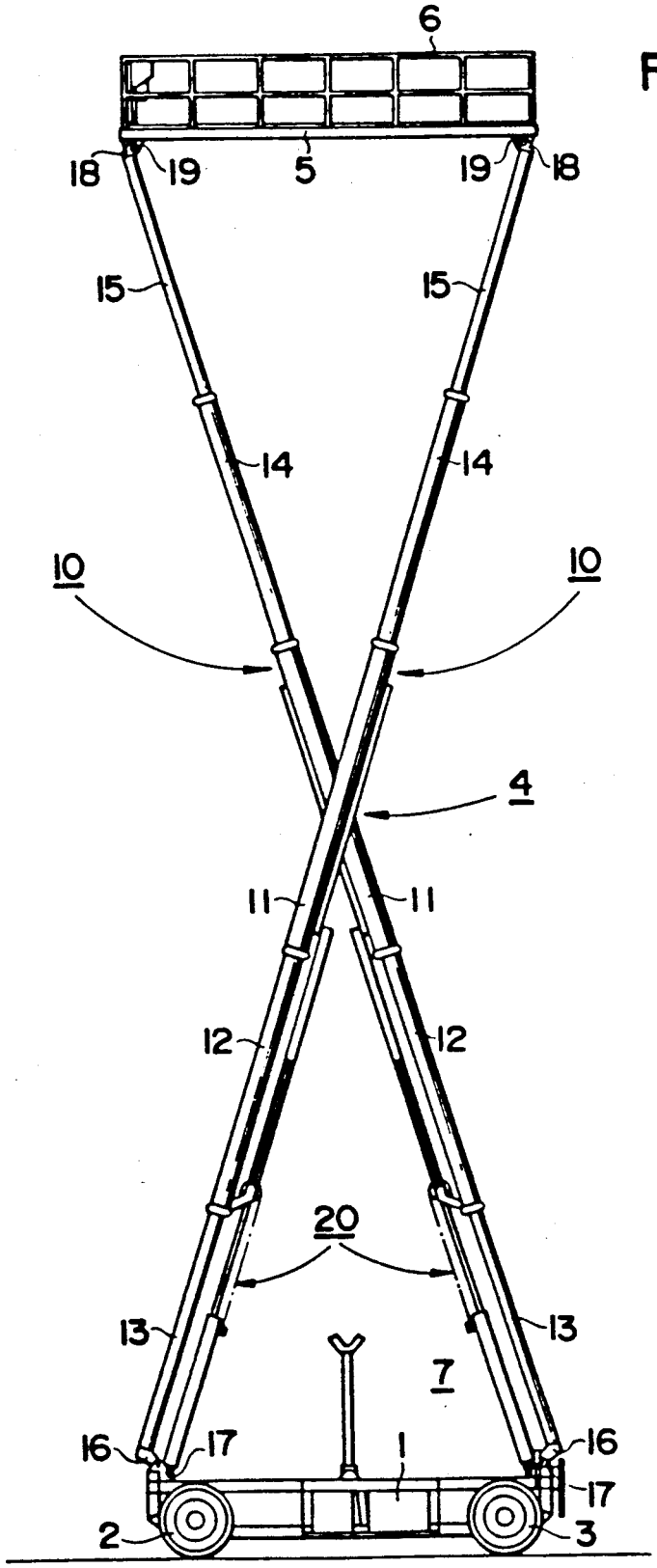
FIG. 3 is a side view of the lifting apparatus in FIG. 1 in which the platform is raised to its uppermost position.
Figure 4:
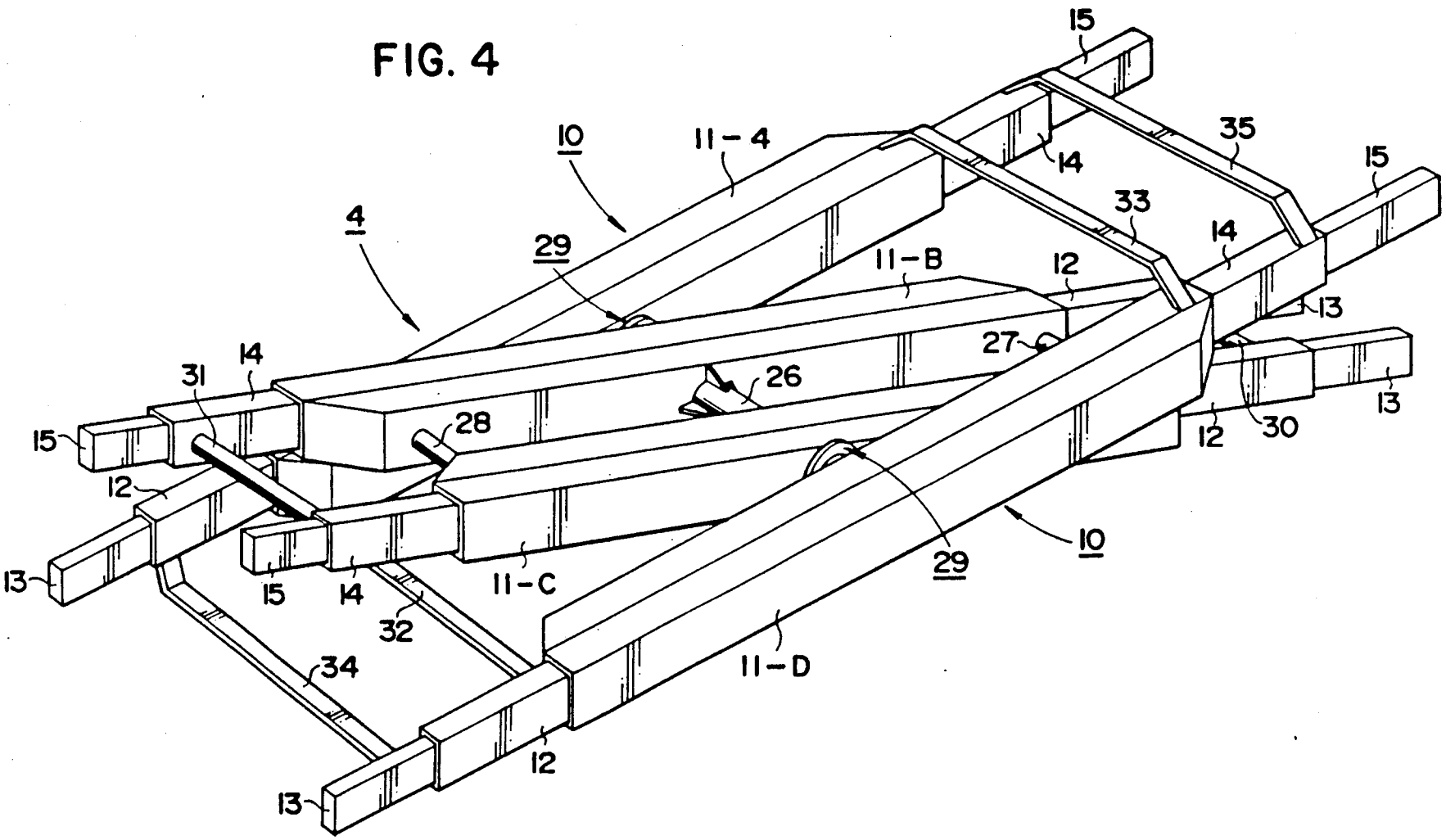
FIG. 4 is a schematic perspective view to assist in explaining a stretch mechanism.
Figure 5:
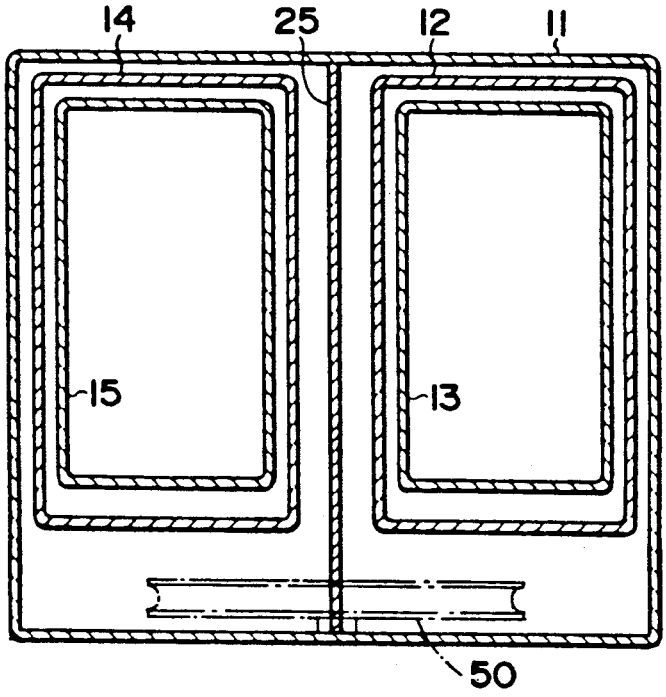
FIG. 5 is a cross sectional view to assist in explaining the structure of the middle booms.
Figure 9:
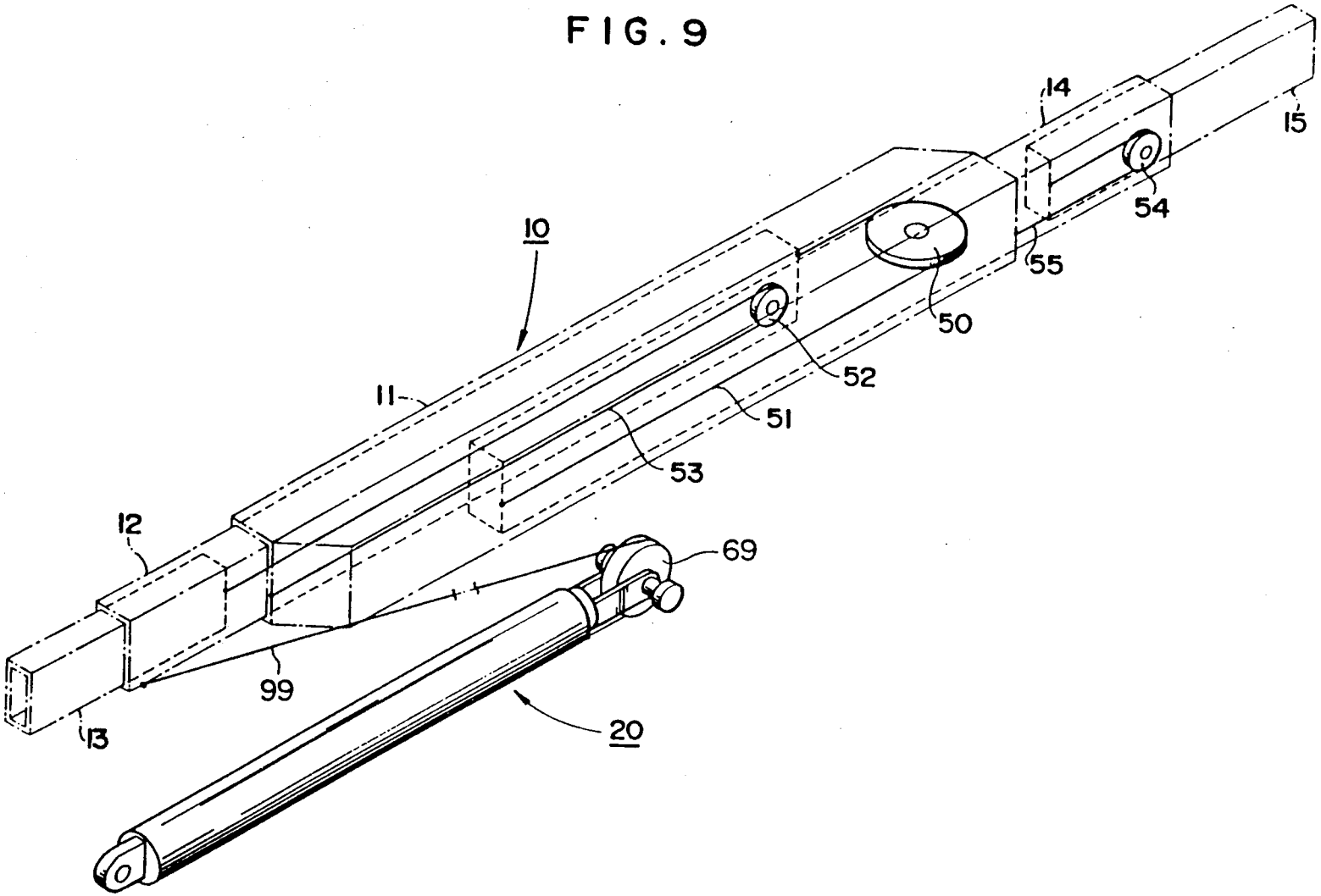
FIG. 9 is a view to assist in explaining the synchronous mechanism in the stretchable boom assembly.

FIG. 9 shows a mechanism for synchronizing the lower middle boom 12, the lower boom 13, the upper middle boom 14 and the upper boom 15 relative to the middle boom 11 in the telescopic boom body 10. According to the first embodiment of the present invention, the amount of telescopic movement of the lower middle boom 12 relative to the middle boom 11 shall be the same as that of the upper middle boom 14 relative to the middle boom 11. In the same way, the amount of telescopic movement of the lower boom 13 relative to the lower middle boom 12 shall be the same as that of the upper boom 15 relative to the upper middle boom 14. That is, it is indispensable that the platform 5 is raised vertically while the platform 5 is maintained in parallel with the ground as illustrated in FIG. 3.

In FIG. 9, one of the four telescopic boom bodies 10 is exemplified but the other three telescopic booms 10 have same structures. FIG. 9 is, as set forth above, the positional relation between the lower boom 13 and the upper boom 15 but is slightly different from the actual mechanism. There is provided a pulley 50 rotatably supported in the inside of the upper portion of the middle boom 11. A wire 51 is wound around the pulley 50 for synchronizing the lower middle boom 12 and the lower boom 13 with the upper middle boom 14 and the upper boom 15 relative to the middle boom 11 and has one end coupled to an upper end of the lower middle boom 12 and the other end coupled to a lower end of the upper middle boom 14. In such a mechanism, the lower middle boom 12 and the upper middle boom 14 are respectively moved by the same amount of telescopic movement relative to the middle boom 11. There is provided a pulley 52 rotatably supported at the upper end side portion of the lower middle boom 12. A wire 53 is wound around the pulley 52 and has one end coupled to an upper end of the lower boom 13 and the other end coupled to a lower end of the middle boom 11. There is provided a pulley 54 rotatably supported at the upper end side portion of the upper middle boom 14. A wire 55 is wound around the pulley 54 and has one end coupled to an upper end of the middle boom 11 and the other end coupled to a lower end of the upper boom 15.

Figure 10:
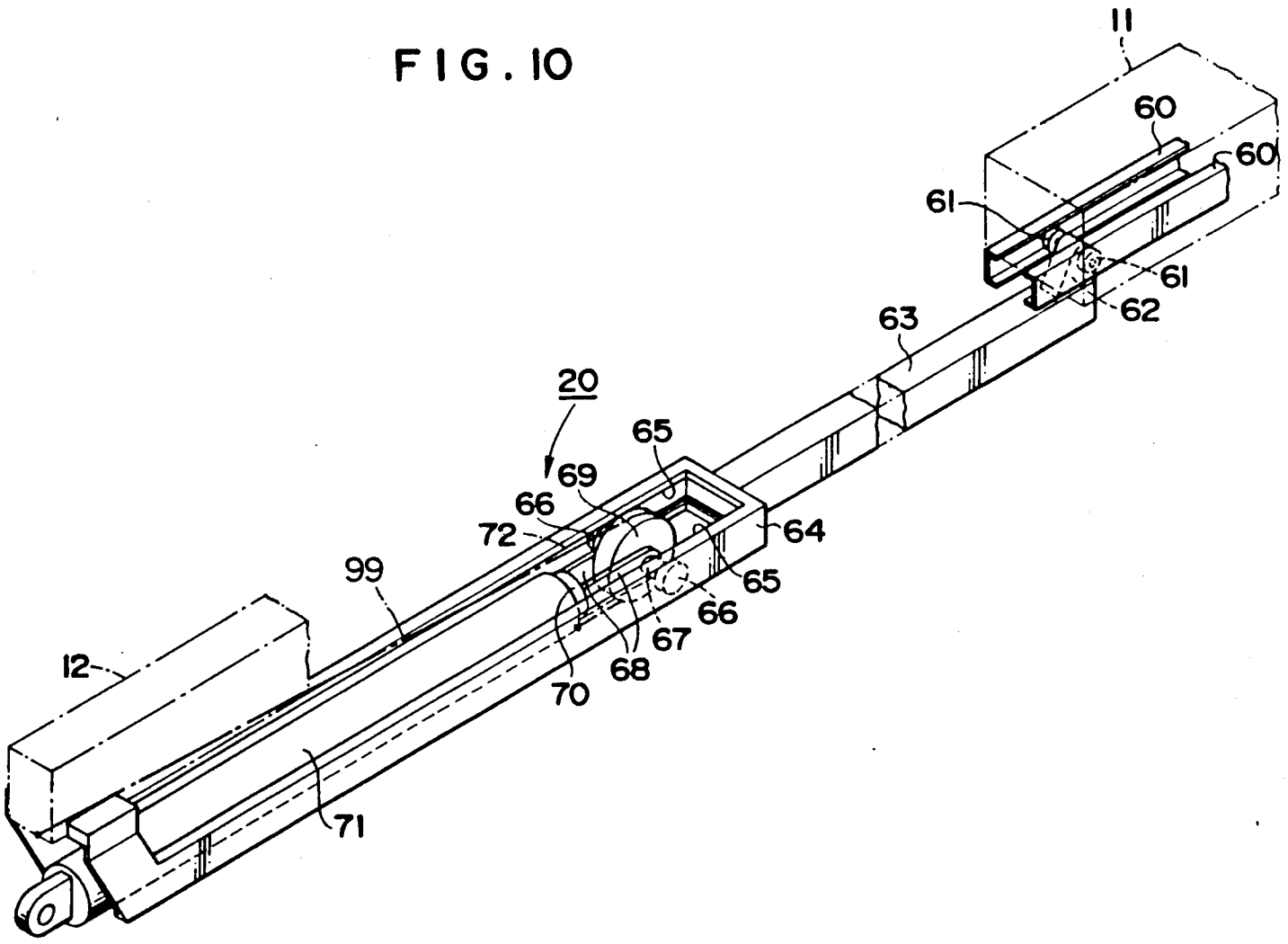
FIG. 10 is a perspective partially cross sectional view to assist in explaining the structure of an operation mechanism.

FIG. 10 is a view showing in detail the operating mechanism 20 according to the first embodiment of the present invention. Four operation mechanisms 20 are provided, one being mounted on each of the four telescopic booms 10.

A pair of guide rails 60 is fixed in a predetermined spaced interval at the lower surface of the middle boom 11 in the longitudinal direction thereof. The pair of guide rails 60 are U-shape in cross section and are disposed so as to oppose one another. The guide rails 60 are fixed to the middle boom 11 and extend along substantially the entire length thereof. Rollers 61 are movably inserted into the inner space between the guide rails 60 and supported by a bearing plate 62. The bearing plate 62 is fixed to an operating rod 63 which is maintained in parallel with the middle boom 11. The operating rod 63 at its lower end is fixed to an upper end of a guide body 64. The guide body 64 is formed in U-shape and defines a narrow and long space between the opposing two leg members and both ends are forked and are coupled to lower ends of the lower middle boom 12. With such an arrangement, the guide body 64 and the operating rod 63 move together with the lower middle boom 12 relative to the middle boom 11. The guide body 64 is, as mentioned above, formed in the U-shape and has guide grooves 65 each U-shape in cross section and provided on the opposing inner sides thereof. There are movable rollers 66 in the grooves 65 and supported by a shaft 67 which is supported by a pair of supporting plates 68. A pulley 69 is supported between the pair of supporting plates 68. The supporting plates 68 are fixed to the tip end of a cylinder rod 72 of a fluid pressure (i.e. hydraulic) cylinder 71. The hydraulic cylinder 71 is positioned inside the inner space of the guide body 64 for operating the cylinder rod 72. The hydraulic cylinder 71 is pivotally coupled with a fixing member 17 at the base thereof. A wire 66 is wound around the pulley 69 and has one end coupled to the lower end of the lower middle boom 12 and the other end coupled to an upper end of the hydraulic cylinder 71.

Figure 11:
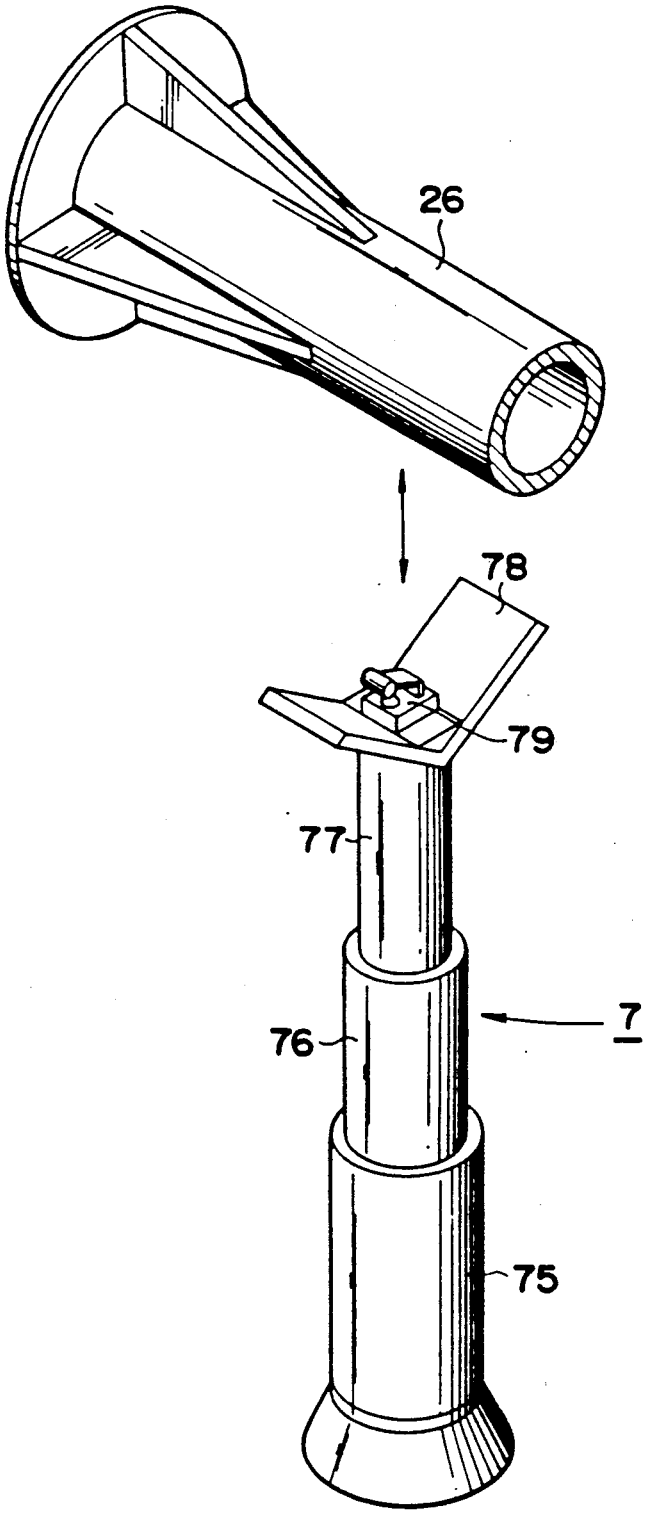
FIG. 11 is an exploded perspective view showing the relation between a kick mechanism and a kick receiver employed according to the present invention.

FIG. 11 shows in detail the kick or support mechanism 7.

The kick or support mechanism 7 is a hydraulic cylinder comprising a plurality of cylinder rods 75, 76, 77 which are telescopically coupled in three stages. The cylinder rod 77 has fixed at its upper end a kick or support body 78, which kick body 78 opens upward in V-shape. The kick body 78 contacts the outer periphery of the tubular kick receiver 26 and can raise the kick receiver 26 and has a limit switch 79 at the V-shaped bottom portion thereof for contacting the outer periphery of the kick receiver 26 and detecting the position of the kick receiver 26.

Figure 12:
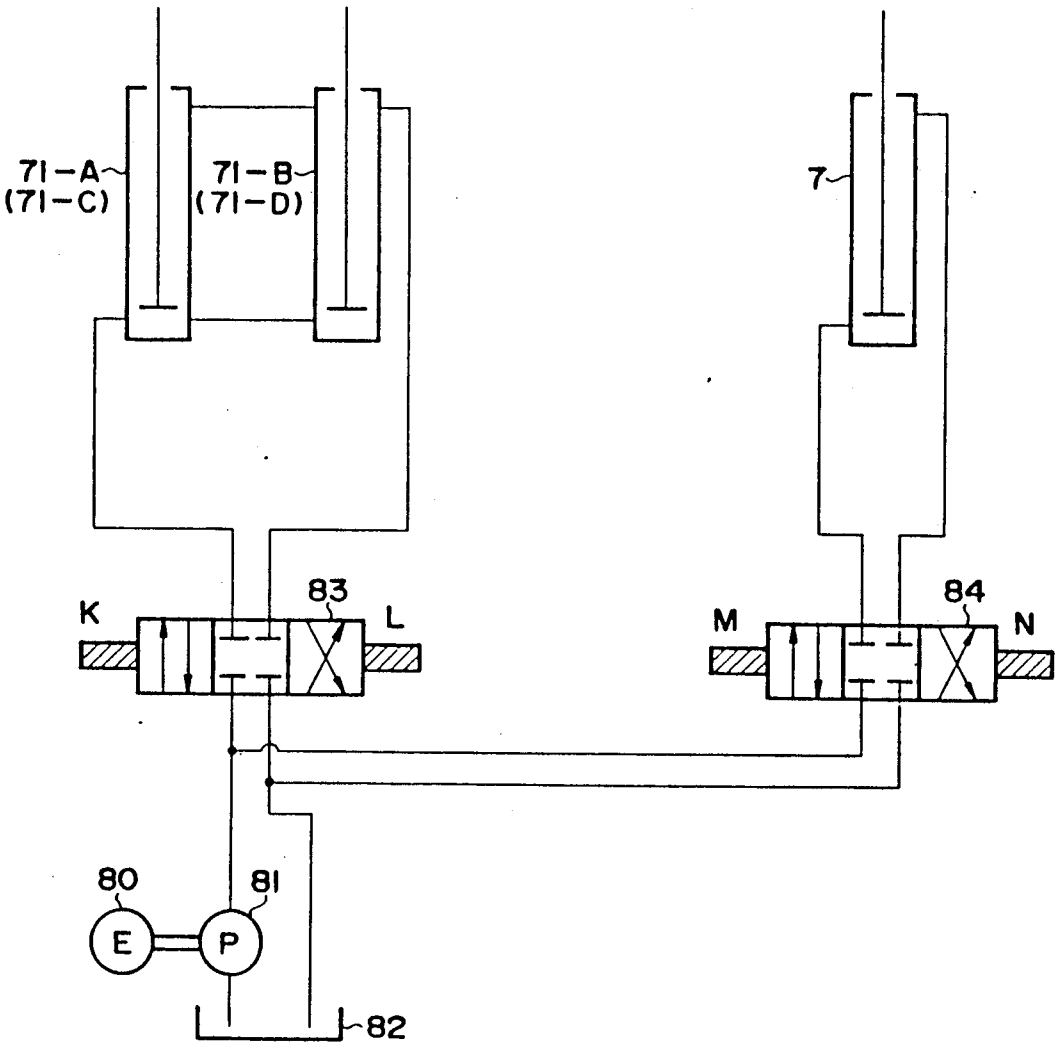
FIG. 12 is a view showing a hydraulic control circuit in the stretch mechanism.

FIG. 12 shows a part of a hydraulic control circuit according to the first embodiment of the present invention. The hydraulic control circuit in FIG. 12 relates to the one for raising the platform 5.

A hydraulic pump 81 is driven by an engine 80 and has an input portion connected to an oil tank 82. The hydraulic pump 81 has an output portion connected to solenoid valves 83 and 84 each having a return oil passage connected to the oil tank 82. The solenoid valve 83 is connected serially to the hydraulic cylinders 71-A and 71-B while the solenoid valve 84 is connected to the kick mechanism 7. These two solenoid valves 83 and 84 can respectively be switched to a closed middle position, a forward position and a backward position. The solenoid valve 83 has coils K and L while the solenoid valve 84 has coils M and N.

Figure 13:
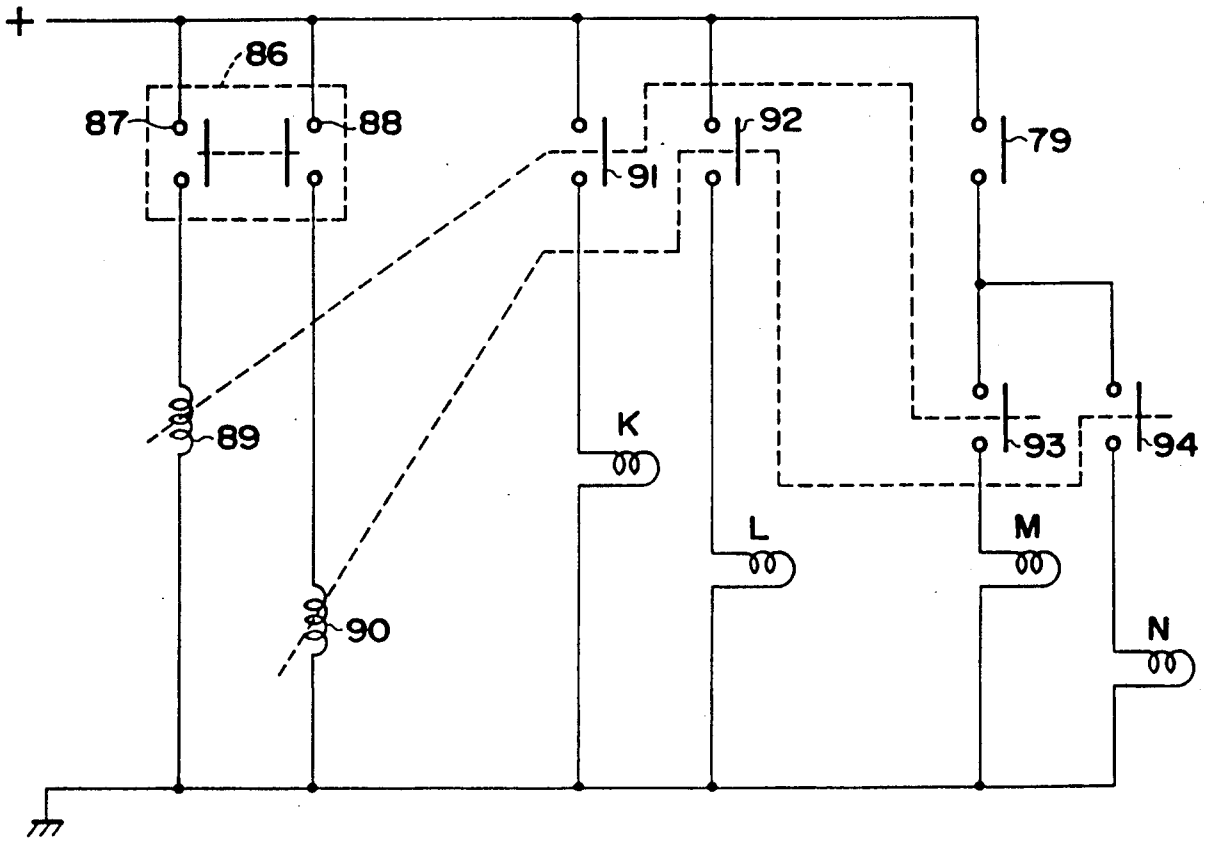
FIG. 13 is a view showing an electric circuit for controlling solenoid valves in the hydraulic circuit in FIG. 12.

FIG. 13 shows an electric circuit according to the embodiment of the present invention.

A control unit (not shown) is attached to the platform 5 and provided with a control switch 86 for raising and lowering the platform 5 by operating thereof by an operator. The control switch 86 includes a contact 87 for controlling a raising operation, a contact 88 for controlling a lowering operation, in which the contact 87 is connectable to a relay 89 while the contact 88 is connectable to a relay 90. The relay 89 controls a normally opened contact 91 connected in series to the coil K while the relay 90 controls a normally opened contact 92 connected in series to the coil L. The limit switch 79 is open when it does not contact the kick receiver 26, and is connected to a normally opened contact 93 openable by the relay 89 and having the coil M in series therewith. The limit switch 79 is also connected to a normally opened contact 94 openable by the coil 90 and having the coil N in series therewith.

An operation of the first embodiment will be described hereinafter.

When the engine 80 mounted on the chassis 1 is actuated to drive the hydraulic pump 81, the hydraulic pump 81 sucks up the oil under pressure from the oil tank 82 and supplies the thus sucked oil under pressure to the solenoid valves 83 and 84. With such operation, the lifting apparatus is ready for controlling the constituents thereof.

Raising the Platform

Figure 2:
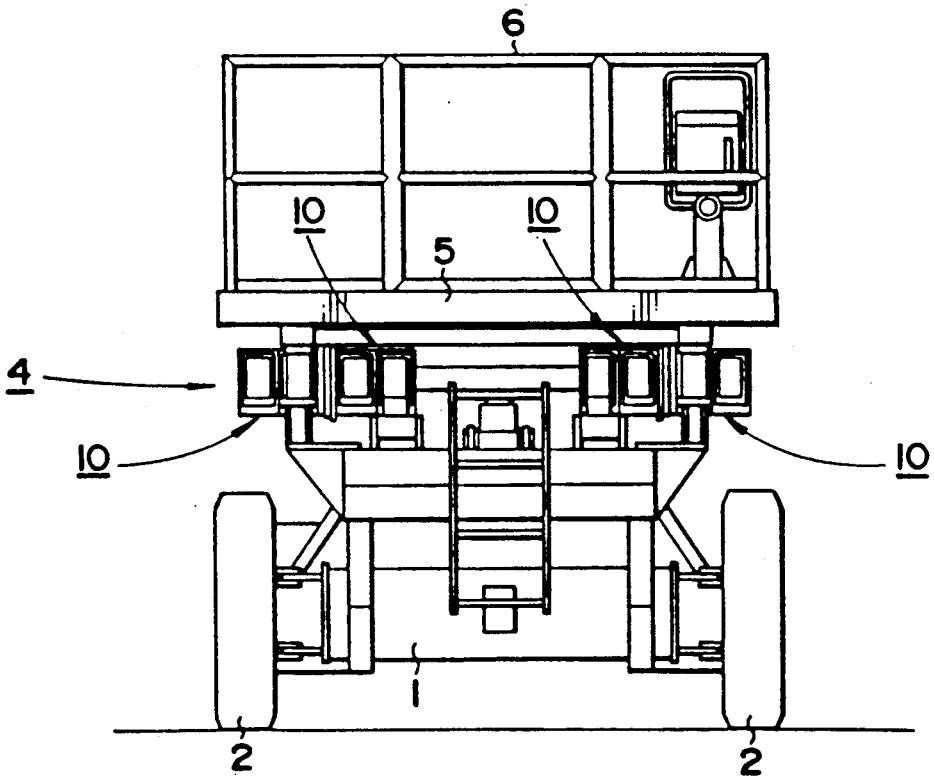
FIG. 2 is a front view of the lifting apparatus in FIG. 1.

A state where the platform 5 is at the lowest position is illustrated in FIGS. 1 and 2. Described hereafter is a case where the lifting apparatus is raised from the lowest position. At the lowest position, the kick receiver 26 is kept in contact with the kick body 78 and the limit switch 79 contacts the outer periphery of the kick receiver 26, hence the limit switch 79 is closed.

When the control switch 86 is operated, at the state when the limit switch 79 is closed, to close the contact 87 for raising the platform 5, the relay 87 is operated to close the normally opened contacts 91 and 93.

Thereupon, the current is applied to both the coils K and M, thereby switching the solenoid valves 83 and 84 to the forward position. As a result, the oil under pressure is supplied to each of four hydraulic cylinders 71-A, 71-B, 71-C and 71-D and the kick mechanism. Thereupon, each of the hydraulic cylinders 71 extends in the longitudinal direction thereof so as to pull up each of the booms in the telescopic boom body 10. However, when the platform 5 is positioned at its lowest position (the state as illustrated in FIG. 1), the booms are respectively directed in a straight line and arranged in parallel with each other wherein the force is not decomposed in the direction to rotate in X-shape around the bearing mechanism 29, and hence the platform 5 does not rise. However, since the oil under pressure is at the same time supplied through the solenoid valve 84 to the kick mechanism 7, the cylinder rods 75, 76, 77 respectively extend upward and the kick body 78 pushes the kick receiver 26 upward. Accordingly, the middle boom bodies 11-A, 11-B, 11-C and 11-D are respectively raised slightly to form an X-shape.

When the telescopic booms are raised by the kick mechanism 7 to slightly form the X-shape, each of the hydraulic cylinders 71 starts to operate. Firstly, when the hydraulic cylinder 71 is operated to push the cylinder rod 70, the pulley 69 is pushed out upward together with the supporting plate 68 so as to pull up the wire 66. Since the wire 66 is coupled to the upper end of the hydraulic cylinder 71 at one end thereof, the wire 66 operates so as to pull up the lower middle boom 12 when the pulley 69 is pushed out. Hence, each of the lower middle booms 12 starts to extend so as to pull out the lower boom 13 from its lower end.

At this time, although the guide body 64 moves forward together with the lower middle boom 12 and with the operating rod 63, the distance between the guide body 64 and the middle boom 11 is varied. However, the tip end of the operating rod 63 moves within the guide rail 60 by rollers 61, the operating rod 63 and the guide body 64 respectively keep in parallel with the lower middle boom 12 and assist the hydraulic cylinder 71 so as to keep and move in parallel with the lower middle boom 12.

In such manner, the lower middle boom 12 is pushed up by the hydraulic cylinder 71 and the lower boom 13 is pulled out from the lower end of the lower middle boom 12 so that the telescopic boom bodies 10 are interlocked with each other. The interlocking operation will be described with reference to FIG. 9. When the lower middle boom 12 is pushed up, the lower boom 13 is pulled out from the lower end of the lower middle boom 12. Since the pulley 52 is supported at the upper end portion of the lower middle boom 12, the lower boom 13 is positioned in the same position but the wire 53 is pulled up since the pulley 52 is raised, which causes the middle boom 11 to move relative to the lower middle boom 12. The distance of movement of the middle boom 11 relative to the lower middle boom 12 is set to be the same length as that of the lower boom 13 relative to the lower middle boom 12 when the former is pulled out from the latter. Hence, the lower middle boom 12 and the lower boom 13 are respectively pulled out for the same length relative to the middle boom 11. When the lower middle boom 12 is pulled out from the middle boom 11, the wire 51 is pulled out downward which is delivered to the upper middle boom 14 through the pulley 50 and the upper middle boom 14 is pulled out from the upper open end of the middle boom 11. The amount of movement of the upper middle boom 14 when it is pulled out from the middle boom 11 is the same as that of the lower middle boom 12 when it is pulled out from the middle boom 11. When the upper middle boom 14 is further pulled out from the middle boom 11, the pulley 54 supported by the upper middle boom 14 pulls the wire 55. Since one end of the wire 55 is fixed to the middle boom 11, the wire 55 is still positioned in the same position at one end thereof but the upper boom 15 to which the other end of the wire is fixed is pulled out from the upper middle boom 14. The amount of movement of the upper boom 15 when it is pulled out from the upper middle boom 14 is the same as that of the upper middle boom 14 when it is pulled out from the middle boom 11.

With such an interlocking operation of the wires 51, 53 and 55, the lower middle boom 12, the lower boom 13, the upper middle boom 14 and the upper boom 15 are pulled out respectively relative to the middle boom 11, the amount of movement of the lower middle boom 12 when it is pulled out from the middle boom 11 is the same as that of the upper middle boom 14 when it is pulled out from the middle boom 11, the amount of movement of the lower boom 13 when it is pulled out from the lower middle boom 12 is the same as that of the upper boom 15 when it is pulled out from the upper middle boom 14, and hence each of the booms is synchronized for the same amount of movement.

Although the interlocking operation is exemplified for the synchronous operation of one of the telescopic boom bodies 10, the same synchronous operation is effected for the other telescopic boom bodies 10. The amount of movements of all the booms of each of the telescopic boom bodies 10 forming the X-shape is the same, whereby the lifting mechanism 4 can extend to a large amount while the X-shape thereof is maintained but the upper and lower portions thereof are intermittently moved to keep the X-shapes analogous with one another. Accordingly, the platform 5 is raised vertically upward relative to the chassis 1 while it is kept horizontal relative to the ground.

With such series of operations, namely, when the hydraulic cylinders 71 are operated to extend each of the booms of the telescopic boom bodies 10, the lifting apparatus can be raised to an elevated spot whereby the lifting apparatus is raised from the state illustrated in FIG. 1 to the state illustrated in FIG. 3 and the entire length of the telescopic boom bodies 10 when they are fully extended as shown in FIG. 3 becomes about five times as long as the length when they are contracted as shown in FIG. 1. When the lifting apparatus 4 is raised to a predetermined position and the supply of pressurized oil to the hydraulic cylinder 71 is stopped, the platform 5 is kept at the elevated spot whereby the operator can work at the elevated spot.

In the telescopic movement of the pair of telescopic boom bodies 10, two middle booms 11-A, 11-B and 11-C, 11-D are rotated relative to each other by the bearing mechanism 29. In the bearing mechanism 29, since the sliding retainers 46 are engaged in the guide groove 41 of the bearing washer 40, the retainers slide and move along the inner periphery of the guide groove 41. As a result, the middle booms 11-A and 11-B can be rotated relatively in opposite directions without varying the left and right intervals thereof, whereby both the middle booms 11-A and 11-B can be maintained in the X-shape.

When the bearing mechanism 29 is raised by each of the hydraulic cylinders 71, the kick receiver 26 rises by its own force and moves away from the upper surface of the kick body 78, so that the limit switch 79 is opened. Hence, no current is applied to the coil M so that the solenoid valve 84 is switched to the closed middle position. Thereafter, the platform 5 and the bearing mechanism 29 are respectively raised by the successive operations as set forth above while the cylinder rods 75, 76 and 77 of the kick mechanism 7 are kept stretched at maximum and stopped.

Lowering the Platform

The lowering operation of the platform 5 will now be described.

The operator on the platform 5 operates the control switch 86 to close the contact 88 thereof, whereby the current is applied to the relay 90 to close the normally opened contacts 92 and 94. Hence, the current is applied to the coil L but no current is applied to the coil N since the limit switch 79 is opened. With the application of the current to the coil L, only the solenoid valve 83 is switched to the backward position so that the oil under pressure is supplied through the hydraulic pump 81 to each of the hydraulic cylinders 71 in the reversed direction. As a result, the length of each of the hydraulic cylinders 71 is contracted so that each of the cylinder rods contracts into the respective hydraulic cylinder 71. The lower middle boom 12 and the upper middle boom 14 move respectively, contrary to that as set forth above, toward the middle boom 11 while the lower boom 13 moves toward the lower middle boom 12 and the upper boom 15 moves toward the upper middle boom 14, so that the entire length of the telescopic boom 10 is contracted as a whole. This operation is reverse to the operation set forth above, whereby the platform 5 is gradually lowered.

The middle boom 11 is lowered while it is rotated about the bearing mechanism 29 by which the middle booms 11 are supported to form the X-shape. When the kick receiver 26 of the bearing mechanism 29 lowers to contact the kick body 78. the kick receiver 26 is supported by the kick body 78. At the same time, the limit switch 79 contacts the kick receiver 26 so that the limit switch 79 is closed, thereby applying current to the coil N through the normally opened contact 94. Hence, the solenoid valve 84 is switched to the backward position so that the oil under pressure is supplied from the hydraulic pump 81 to the kick mechanism 7 in the reversed direction.

Then, the kick body 78 contacts the kick receiver 26 and supports the load of the platform 5 as the kick mechanism 7 is gradually lowered. That is, the load of the platform 5 is hitherto received by each of the hydraulic cylinders 71, but a part of the load is received by the kick body 78 by switching the solenoid valve 84 to the backward position. Thus, a part of the load can be supported by the kick mechanism 7 while it is contracted. The tension force of the wires 53 and 55 operated by the hydraulic cylinder 71 is reduced. Accordingly, the angle of inclination of the middle boom 11 relative to the chassis is small, hence even if the component of the load to be applied to the platform 5 becomes great, the component of the force imposed on the wires 53 and 55 does not become great.

Figure 14:
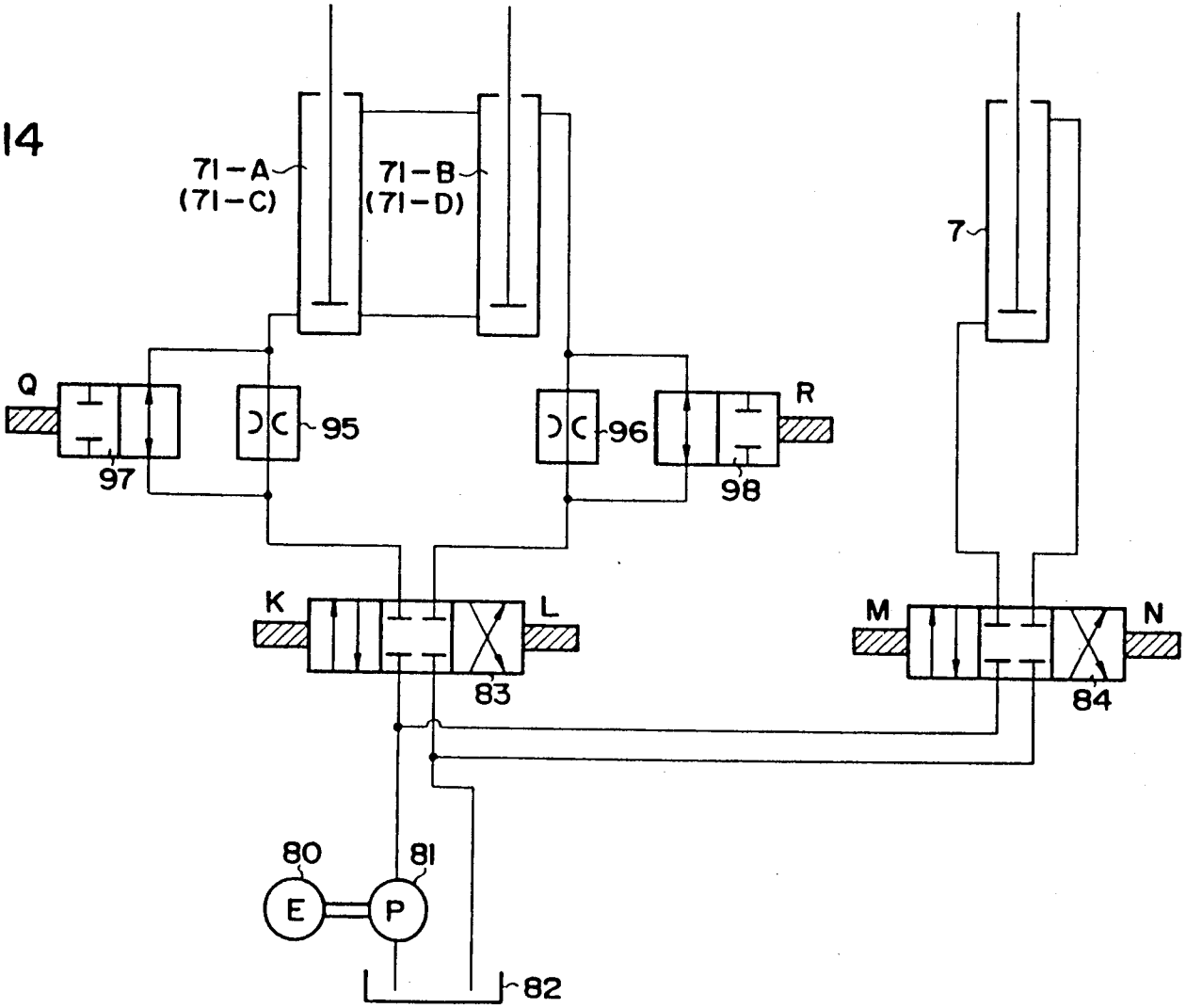
FIG. 14 is a view showing a hydraulic control circuit according to a second embodiment of the present invention.
Figure 15:
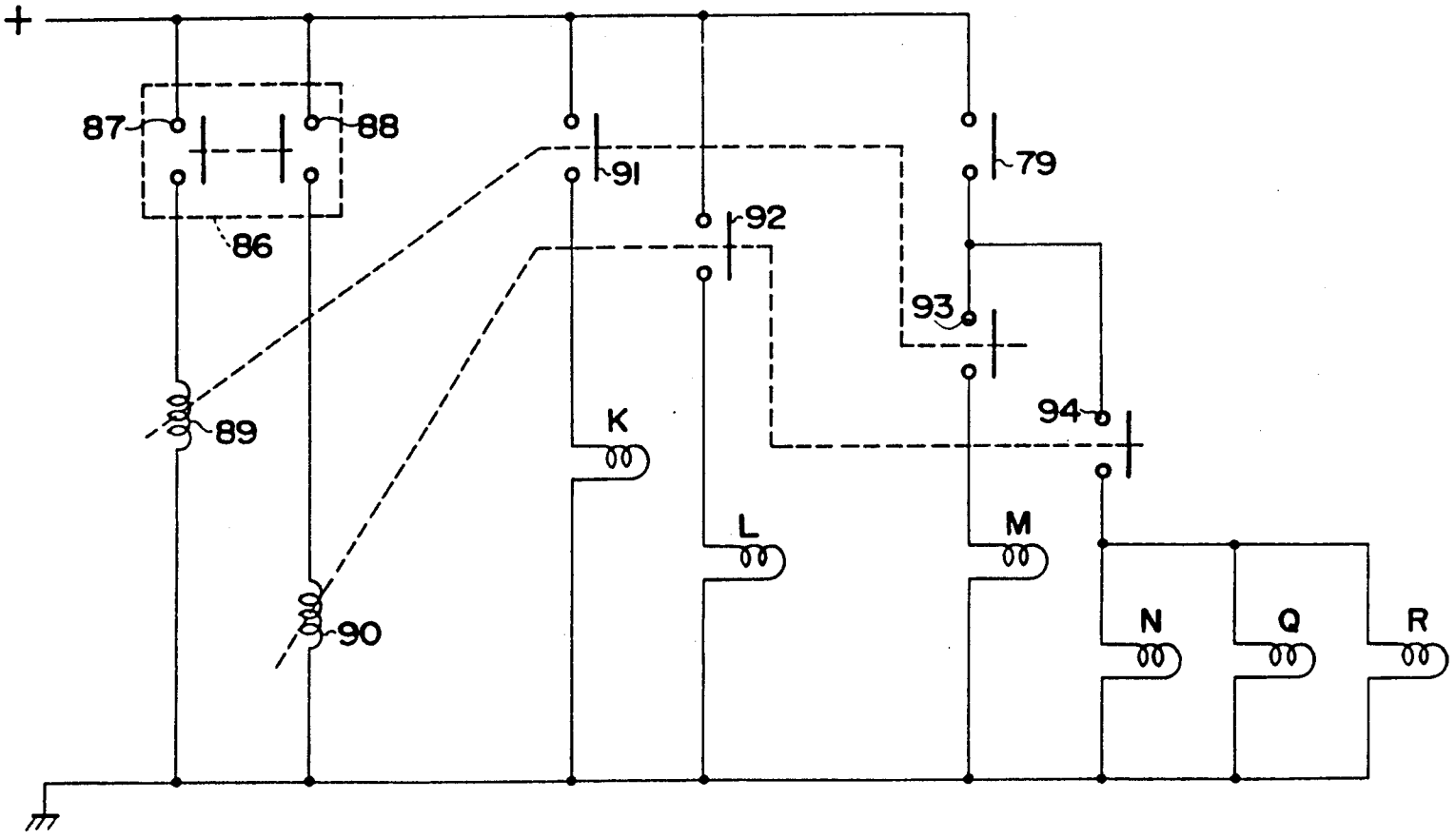
FIG. 15 is a view showing an electric circuit for controlling solenoid valves in the hydraulic circuit in FIG. 14.

Second Embodiment (FIGS. 14 and 15)

A second embodiment of the present invention will be described with reference to FIGS. 14 and 15.

According to the second embodiment, parts of the hydraulic control circuit and the electric control circuit are varied wherein the elements common to the first embodiment are denoted by the same numerals and the explanation thereof is omitted.

FIG. 14 shows the hydraulic control circuit of the second embodiment.

There are intervened throttle valves 95 and 96 between the solenoid valve 83 and the hydraulic cylinders 71-A and 71-B. There are connected solenoid valves 97 and 98 in parallel with each other for cutting off the hydraulic circuit at both sides of the throttle valves 95 and 96. There is connected a coil Q to the solenoid valves 97 for cutting off the oil passage while there is connected a coil R to the solenoid valve 98 for cutting off the oil passage.

FIG. 15 shows the electric control circuit of the second embodiment wherein there are connected the coils Q and R to the coil N.

When the platform 5 is raised according to the second embodiment, the contact 87 of the control switch 86 is closed in the same way as in the first embodiment. When the contact 87 is closed to actuate the relay 89 so that the normally opened contacts 91 and 93 are closed and the current is applied to the coils K and M, the solenoid valves 83 and 84 are switched to the forward position so that the oil under pressure is supplied to the kick mechanism 7 and the hydraulic cylinder 71 whereby the platform 5 is raised. The operations to be effected thereafter are the same as in the first embodiment.

However, the case where the platform 5 is lowered is slightly different from the first embodiment as set forth above.

That is, in the state where the platform 5 is positioned at an elevated spot before the kick receiver 26 contacts the kick body 78, the limit switch 79 is opened so that the platform 5 is lowered due to the amount of contraction of the hydraulic cylinders 71. When the platform 5 and the bearing mechanism 29 are respectively lowered so that the kick receiver 26 contacts the kick body 78, the limit switch 79 is closed whereby the current is applied to the coils N, Q and R through the contact 94 as already closed by the relay 90. Then, the solenoid valve 84 is switched to the backward position so that the oil under pressure is supplied from the hydraulic pump 81 to the kick mechanism 7 in the reversed direction, thereby gradually lowering the cylinder rods 75, 76 and 77 of the kick mechanism 7.

At the same time, since the current is applied to the coils Q and R, the solenoid valves 97 and 98 are closed so that the direct connections between the solenoid valve 83 and the hydraulic cylinders 71-A and 71-B are stopped. Accordingly, there is supplied the oil under pressure which is reversed in the flow thereof through the throttle valves 95 and 96 into the hydraulic cylinders 71-A and 71-B at low speed. As a result, the hydraulic cylinders 71-A and 71-B are contracted at low speed so that the lowering speed of the kick mechanism 7 is increased, thereby operating following the operation of the kick mechanism 7.

Hence, there is always applying the tensile force to the wires 53 and 55 pulled up by the hydraulic cylinder 71 and the wires 53 and 55 follow the operation of the kick mechanism 7. In this operation, differing from the first embodiment, the hydraulic cylinders 71-A and 71-B are directly connected to the solenoid valve 83 and kept contracted, thereby occurring the phenomenon that the contracting speed of the hydraulic cylinder 71 is greater than that of the kick mechanism 7, thereby generating looseness in the wires 53 and 55. As a result, the wires 53 and 55 are likely to hang loosely inside the telescopic boom body 10. It is possible to prevent the phenomena of dropping the pulleys 50, 52, 54 and 60 wound around the wires 53 and 55 out of the wires 53 and 55 and of the non-raising operation of the wires 53 and 55 which is likely to occur depending on the looseness of the wires 53 and 55.

Although the telescopic boom body 10 is structured to be telescopically moved in five stages by slidably moving the respective lower middle boom 12, the lower boom 13, the upper middle boom 14 and the upper boom 15 into the middle boom 11, the present invention is not limited to the embodiment set forth above but can be varied such that the lower boom and the upper boom can be directly telescopically moved into the middle boom 11 at three stages, whereby the same effect as the first and second embodiments can be obtained.

Furthermore, the provision of the kick mechanism enables the kick mechanism to receive most of the component of the fourth of the platform, thereby preventing the wire or chain for synchronizing the upper and the lower booms from receiving the load of the platform. The lifting apparatus can be light weight as a whole because the safety factor of the wires and chains can be reduced.

Although the invention has been described in its preferred form with a certain degree of particularity, it is to be understood that many variations and changes are possible in the invention without departing from the scope thereof.

What is claimed is:

1. A lifting apparatus comprising:

a movable chassis;

a platform disposed over the chassis;

a lifting mechanism comprising at least one set of paired stretchable boom assemblies disposed between the chassis and the platform for raising and lowering the platform;

the one set of paired stretchable boom assemblies comprising a pair of middle booms which are joined in a generally X-shape for relative pivoting between the middle booms substantially about the center portions thereof, lower middle booms movably telescopically inserted into the middle booms along the longitudinal direction thereof from lower end openings of the middle booms, lower booms movably telescopically inserted into the lower middle booms from lower end openings of the lower middle booms and connected to the chassis at lower ends thereof, upper middle booms movably telescopically inserted into the middle booms along the longitudinal direction thereof from upper end openings of the middle booms, and upper booms movably telescopically inserted into the upper middle booms from upper end openings of the upper middle booms and connected at upper ends thereof to the platform.

2. A lifting apparatus according to claim 1, wherein said lifting mechanism comprises two sets of paired stretchable boom assemblies.

3. A lifting apparatus according to claim 2, wherein one set of stretchable boom assemblies includes a reinforcing rod disposed between the pair of lower middle booms, a reinforcing rod disposed between the pair of upper middle booms and reinforcing rods disposed between the pair of middle booms at the upper and lower portions thereof, and the other set of stretchable boom assemblies includes a reinforcing rod disposed between the pair of lower middle booms, a reinforcing rod disposed between the pair of upper middle booms and reinforcing rods disposed between the pair of middle booms at the upper and lower portions thereof.

4. A lifting apparatus according to claim 1, including a kick mechanism having one end fixed to the chassis and the other end provided with a kick body capable of supporting the centers of the middle booms and provided with a detecting means for detecting the contact between the middle booms and the kick mechanism, the kick mechanism being capable of lowering while supporting the load of the boom assemblies upon reception of a detecting signal issued when the detecting means detects that the kick mechanism contacts the middle booms.

5. A lifting apparatus according to claim 4, wherein the lifting mechanism comprises two sets of paired stretchable boom assemblies.

6. A lifting apparatus according to claim 1, including a bearing mechanism for turning the pair of middle booms relative to each other at the center portions thereof, the bearing mechanism composed of a ring shaped bearing washer which is brought into contact with an outer side surface of one said middle boom, the bearing washer having a circular guide groove defined in an inner peripheral wall, a ring-shaped washer plate fixed at the side surface of the other said middle boom, and a plurality of retainers mounted on the washer plate and slidably engaged in the guide groove.

7. A lifting apparatus according to claim 6, wherein the bearing washer has a plurality of screw holes and is fixed to the side surface of the middle boom by screws inserted into the screw holes, the washer plate having a plurality of screw holes defined therein, and the plurality of retainers being fixed to the washer plate by screws engaged with the screw holes therein.

8. A lifting apparatus according to claim 1, including a synchronizing mechanism for synchronizing the movement of the lower middle boom and the lower boom relative to the middle boom with that of the upper middle boom and the upper boom relative to the middle boom, the synchronizing mechanism including a first pulley rotatably supported at the inside of the upper portion of the middle boom, a first wire wound around the first pulley and having one end coupled to an upper end of the lower middle boom and the other end coupled to a lower end of the upper middle boom, a second pulley rotatably supported at the upper end side portion of the lower middle boom, a second wire wound around the second pulley and having one end coupled to an upper end of the lower boom and the other end coupled to a lower end of the middle boom, a third pulley rotatably supported at the upper end side portion of the upper middle boom, and a third wire wound around the third pulley and having one end coupled to an upper end of the middle boom and the other end coupled to a lower end of the upper boom.

9. A lifting apparatus according to claim 8, further comprising an operating mechanism.

10. A lifting apparatus according to claim 1, further comprising a guide member composed of a pair of guide rails spaced at a predetermined interval and fixed at the lower surface of the middle boom along the longitudinal direction thereof, a guide body connected to the guide member by an operating rod which is maintained in parallel with the middle boom and an operating mechanism composed of a hydraulic cylinder positioned inside the inner space of the guide body and rotatably coupled to a fixing member of the chassis at the base end thereof, a cylinder rod of the hydraulic cylinder fixed to the guide body at the tip end thereof.

11. A lifting apparatus according to claim 10, wherein the guide member further comprises rollers movably inserted into the inner space of the guide rails and supported by a bearing plate, the bearing plate fixed to one end of the operating rod which is maintained in parallel with the middle boom, the guide rails having a U-shape in cross section and the inner spaces thereof being disposed to oppose each other, the operating rod coupled and fixed to an upper end of a guide body at the lower end thereof, the guide body formed substantially in U-shape and defining a narrow and long space between the opposing two legs thereof and both ends being forked and coupled to the lower end of the lower middle boom, the guide body having guide grooves each U-shape in cross section and provided at the opposing inner sides thereof, rollers inserted into the grooves and supported by a shaft which is supported by a pair of supporting plates, a pulley supported between the pair of supporting plates, the supporting plates respectively fixed to the tip end of a cylinder rod of the hydraulic cylinder, the operating mechanism further comprises a wire wound around a pulley and having one end coupled to the lower end of the lower middle boom and the other end coupled to an upper end of the hydraulic cylinder.

12. A lifting apparatus comprising:

a movable chassis;

a platform disposed over the chassis;

a lifting mechanism comprising at least one set of paired stretchable boom assemblies disposed between the chassis and the platform for raising and lowering the platform;

the one set of paired stretchable boom assemblies comprising a pair of X-shaped middle booms which are joined in a generally X-shape for relative pivoting between the middle booms substantially about the center portions thereof, lower booms movably telescopically inserted into the middle booms along the longitudinal direction thereof and connected to the chassis at the lower ends thereof, and upper booms movably telescopically inserted into the middle booms along the longitudinal direction thereof; and a kick mechanism having one end fixed to the chassis and the other end provided with a kick body capable of supporting the centers of the middle booms and provided with a detecting means for detecting contact between the middle booms and the kick mechanism, the kick mechanism being capable of lowering while supporting the load of the boom assemblies upon reception of a detecting signal issued when the detecting means detects that the kick mechanism contacts the middle booms.

13. A lifting apparatus according to claim 12, wherein the lifting mechanism comprises two sets of paired stretchable boom assemblies.

14. A lifting apparatus according to claim 12, wherein the kick mechanism comprises a hydraulic cylinder composed of a plurality of cylinder rods, the cylinder rod having a kick body fixed thereto at its upper end, which kick body is opened upward in V-shape and contacts the outer periphery of the kick receiver and can raise the kick receiver, the kick body also having a limit switch at the V-shaped bottom portion thereof for contacting the outer periphery of the kick receiver and detecting the position of the kick receiver.

15. A lifting apparatus according to claim 12, including a hydraulic control circuit for raising the platform, the hydraulic control circuit comprising a hydraulic pump having an input portion connected to an oil tank and an output portion connected to first and second solenoid valves each having a return oil passage connected to the oil tank, the first solenoid valve being connected serially to the hydraulic cylinders and the second solenoid valve being connected to the kick mechanism, the solenoid valves respectively being switched to a middle position, a forward position and a backward position, the first solenoid valve having coils and the second solenoid valve having coils.

16. A lifting apparatus according to claim 15, wherein the hydraulic circuit is interlocked with an electric circuit, the electric circuit comprising a control switch mounted on the platform for raising and lowering the platform, the control switch including a first contact for controlling a raising operation and a second contact for controlling a lowering operation, in which the first contact is connected to a first relay while the second contact is connected to a second relay, the first relay controlling a normally opened contact connected to the coil in series therewith, the second relay controlling a normally opened contact connected to the coil in series therewith, the limit switch being opened when it does not contact the kick receiver and connected to a normally opened contact to be closed by the first relay and the coil in series, the limit switch being connected to a normally opened contact to be closed by the second relay and the coil in series.

17. A lifting apparatus according to claim 15, wherein the hydraulic control circuit comprising throttle valves intervened between the first solenoid valve and the hydraulic cylinders, further solenoid valves in parallel with each other for cutting off the hydraulic circuit at both sides of the throttle valves, and coils connected to the last-mentioned solenoid valves for cutting off the respective oil passage.

18. A lifting apparatus according to claim 17, wherein the hydraulic circuit is interlocked with an electric circuit, the electric circuit comprising a control switch mounted on the platform for raising and lowering the platform, the control switch including a first contact for controlling a raising operation and a second contact for controlling a lowering operation, in which the first contact is connected to a first relay, the second contact is connected to a second relay, the first relay controlling a normally opened contact connected to a coil in series therewith, the second relay controlling a normally opened contact connected to the coil in series therewith, the limit switch being opened when it does not contact the kick receiver and connected to a normally opened contact to be closed by the first relay and the coil in series, the limit switch being connected to a normally opened contact to be closed by the second relay and the coil in series, and further coils connected in parallel with the coil.

* * * * *